US005092243A

United States Patent [19]

Hawkins et al.

[11] Patent Number: 5,092,243

[45] Date of Patent: Mar. 3, 1992

[54] PROPELLANT PRESSURE-INITIATED PIEZOELECTRIC POWER SUPPLY FOR AN IMPACT-DELAY PROJECTILE BASE-MOUNTED FUZE ASSEMBLY

[75] Inventors: Warren E. Hawkins, Plymouth; Donald M. Merhar, Excelsior, both of Minn.

[73] Assignee: Alliant Techsystems Inc., Edina, Minn.

[21] Appl. No.: 354,055

[22] Filed: May 19, 1989

[51] Int. Cl.[5] ..... F42C 11/02

[52] U.S. Cl. ..... 102/210; 310/357

[58] Field of Search ..... 102/210, 207; 310/340, 310/342, 357-359

[56] References Cited

U.S. PATENT DOCUMENTS

| | | | |
|---|---|---|---|
| 2,991,716 | 7/1961 | Israel et al. | 102/70.2 |
| 3,158,762 | 11/1964 | Horan | 310/357 |
| 3,200,749 | 8/1965 | Downs | 102/70.2 |
| 3,239,678 | 3/1966 | Kolm et al. | 307/43 |
| 3,397,329 | 8/1968 | Riedel | 102/210 |
| 3,470,818 | 10/1969 | Harnau | 102/210 |
| 3,756,157 | 9/1973 | England et al. | 102/70.2 R |
| 3,780,572 | 12/1973 | Roeha | 73/67.5 R |
| 3,859,746 | 1/1975 | Pecksen | 42/84 |
| 3,941,058 | 3/1976 | Gawlick et al. | 102/70.2 GA |
| 3,963,966 | 6/1976 | Mohr | 102/210 |
| 3,967,555 | 7/1976 | Gawlick et al. | 102/70.2 GA |
| 3,976,898 | 8/1976 | Newson | 102/210 |
| 4,087,716 | 5/1978 | Heywang | 310/359 |
| 4,090,448 | 5/1978 | Rose et al. | 102/70.2 GA |
| 4,138,946 | 2/1979 | Postler et al. | 102/210 |
| 4,141,298 | 2/1979 | Weidner | 102/210 |
| 4,241,662 | 12/1980 | Rüdenauer et al. | 102/210 |
| 4,280,410 | 7/1981 | Weidner | 102/210 |
| 4,291,626 | 9/1981 | Nakahara | 102/200 |
| 4,368,670 | 1/1983 | Weidner | 102/202.5 |
| 4,434,717 | 3/1984 | Erickson | 102/210 |

FOREIGN PATENT DOCUMENTS

| | | | |
|---|---|---|---|
| 2043340 | 3/1972 | Fed. Rep. of Germany | 102/210 |

*Primary Examiner*—Stephen Johnson
*Attorney, Agent, or Firm*—William T. Udseth

[57] ABSTRACT

A piezoelectric power supply for a fuze assembly includes a stacked array of piezoelectric ceramic discs, a hollow can for holding the stacked piezoelectric discs, flexible electrical circuits interposed between the discs and the interconnecting respective positive and negative faces of the discs. The can is deformable upon receipt of a predetermined pressure impulse for transmitting the pressure to the discs. The flexible circuits conduct electrical current and provide positive and negative terminals for supplying electrical power upon deformation of the can and the piezoelectric discs by the pressure impulse.

13 Claims, 2 Drawing Sheets

PROPELLANT PRESSURE-INITIATED PIEZOELECTRIC POWER SUPPLY FOR AN IMPACT-DELAY PROJECTILE BASE-MOUNTED FUZE ASSEMBLY

BACKGROUND OF THE INVENTION

The Government has rights in this invention pursuant to Contract No. F08635-85-C-0151, awarded by the Department of the Air Force.

FIELD OF THE INVENTION

The present invention generally relates to a an air combat projectile for cased telescoped ammunition and, more particularly, is concerned with an electronic impact-delay, base-mounted fuze assembly for the air combat projectile employing a propellant pressure-initiated piezoelectric power supply.

DESCRIPTION OF THE PRIOR ART

Cased telescoped ammunition is generally well-known. Typically, a round of cased telescoped ammunition includes an elongated cylindrical case defining a chamber that contains a propellant charge. The propellant charge has an axial bore through which extends a center sleeve in coaxial relation with the case and fastened at its opposite ends to the opposite ends of the case. A telescoped projectile is housed within a forward portion of the center sleeve, whereas an aft portion of the center sleeve, referred to as a control tube, receives a piston at the aft end of the projectile. A primer is positioned within the control tube aft of the piston, and a small amount of propellant is contained therein between the primer and piston.

The round of ammunition is loaded in a gun chamber located rearwardly of the gun barrel. When the round is fired, the primer ignites the small amount of propellant in the control tube. The resulting hot gas applies a force against the piston, driving the projectile forwardly out of the center sleeve and into the gun barrel. The hot gas next ignites the main propellant charge surrounding the projectile. Burning of the propellant charge produces gas at much higher pressure which drives the projectile through the gun barrel to exit the muzzle at high velocity.

One projectile for use in cased telescoped ammunition is an air combat projectile designed for firing at high velocity and carrying a warhead which is detonated after the projectile impacts, penetrates and travels a short distance within of a target. The air combat projectile must employ a fuze for initiating detonation of the projectile warhead at the proper time after firing of the projectile.

Traditional mechanical fuzes are not suited for use with the air combat projectile. Consequently, a need exists for another type of fuze designed for this projectile. One concept is an electronic, impact-delay, projectile base-mounted fuze. A vital component of such fuze is a self-contained power supply. The power supply must be capable of surviving launch of the projectile (i.e., maintaining electrical continuity) and of generating sufficient electrical power for driving the electronic circuitry controlling and initiating warhead detonation.

SUMMARY OF THE INVENTION

The present invention provides a propellant pressure-initiated piezoelectric power supply designed to satisfy the aforementioned needs. The approach of the present invention is to provide a power supply which utilizes available extremely high energy from the propellant gas pressure that accelerates the projectile in the gun barrel. The piezoelectric material of the power supply is used to make the conversion of energy from pressure to electricity. Low cost proven components in the form of piezoelectric ceramic discs and flexible circuits are used in the power supply.

Accordingly, the present invention is directed to a piezoelectric power supply for a fuze assembly. The power supply comprises: (a) a stacked array of piezoelectric elements having opposite positive and negative faces; (b) a hollow enclosure for holding the stacked array of piezoelectric elements and being deformable upon receipt of a predetermined pressure impulse for transmitting the pressure to the elements; and (c) a plurality of electrical conductor elements interposed between the piezoelectric elements and interconnecting the corresponding positive and negative faces thereof so as to provide positive and negative terminals for supplying electrical charge upon deformation of the enclosure and piezoelectric elements by the pressure impulse.

More particularly, the piezoelectric elements are piezoelectric ceramic discs and the conductor elements are flexible circuits. Further, the conductor elements are arranged with the piezoelectric elements so as to divide the piezoelectric elements in a plurality of groups defining separate power supply portions for providing electrical power to different electrical functions.

The present invention also relates to a fuze assembly including first means for storing an electrical charge to power detonation of an explosive and second means for storing an electrical charge to power electrical means for controlling the timing of the detonation. The separate power supply portions of the power supply are electrically connected to the first and second storing means.

These and other features and advantages of the present invention will become apparent to those skilled in the art upon a reading of the following detailed description when taken in conjunction with the drawings wherein there is shown and described a illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
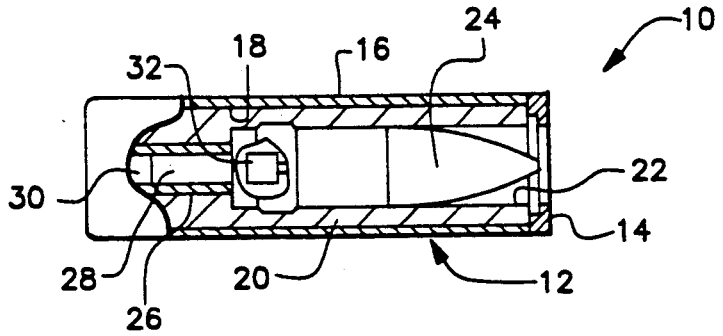
FIG. 1 is a schematic longitudinal view, with portions broken away, of a cased telescoped ammunition round incorporating an air combat projectile and a base-mounted fuze assembly having a propellant pressure-initiated piezoelectric power supply in accordance with the present invention.

Referring now to the drawings, and in particularly to FIG. 1, there is shown a round of cased telescoped ammunition, generally designated by the numeral 10. Briefly, the ammunition round 10 includes an elongated cylindrical case 12 composed of forward and aft end seals or caps 14 (only the forward one being shown) sealed on opposite ends of a skin tube 16. The case 12 defines a chamber 18 that contains an elongated tubular propellant charge 20 having an axial bore through which extends a center sleeve 22 in coaxial relation with the case 12. The sleeve 22 is fastened at its opposite ends to the end caps 14.

An elongated tapered or telescoped projectile 24, preferably an air combat projectile employing a warhead for detonation after target penetration, is housed within the forward portion of the center sleeve 22. The aft portion of the sleeve 22, referred to as a control tube 26 and having a smaller diameter and shorter length, houses a piston 28, a primer (not shown) aft of the piston, and a small amount of propellant 30 therebetween.

In operation, the primer is fired initiating the small amount of propellant 30 in the control tube 26, or aft portion, of the center sleeve 22. Expansion of the resulting gas generated by the initiated propellant 30 applies an increasing force against the piston 28, driving the projectile 24 forward out of the center sleeve 22 and into the rear end of a gun barrel. As the end of the piston 28 moves forward in the control tube 26 of the center sleeve 22, it exposes the main propellant charge 20 which are then ignited by the hot gas generated by the initiated propellant 30. Burning of the propellant charge 20 produces gas at much higher pressure which drives the projectile 24 through the gun barrel to exit the muzzle at high velocity.

Figure 2:
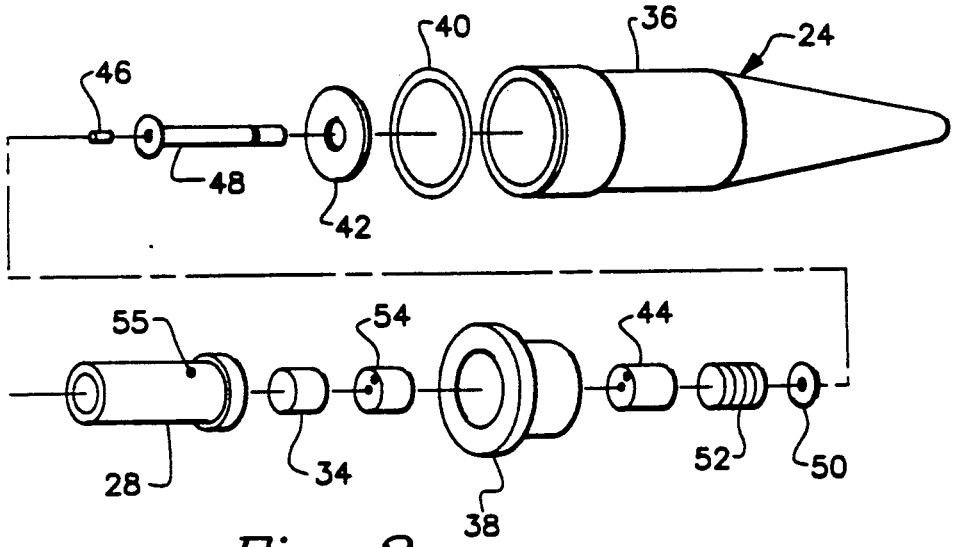
FIG. 2 is an exploded view of the projectile and base-mounted fuze assembly having the power supply of the present invention.

For detonation of its warhead, the projectile 24 houses internally at its aft or base end portion a fuze assembly 32, shown schematically in FIG. 1, which incorporates a self-contained piezoelectric power supply 34 in accordance with the present invention. Referring to FIG. 2, the projectile 24 has a body assembly 36 housing a warhead or high explosive therein and a base 38 which threads with the body assembly 36, capturing a seal ring 40 and explosive support plate 4 therebetween.

Figure 3:
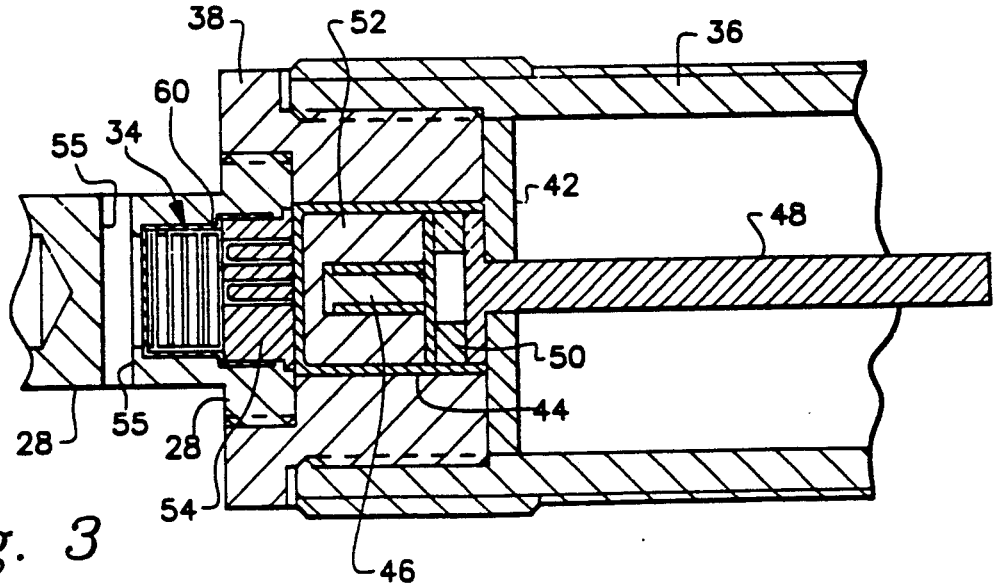
FIG. 3 is an enlarged fragmentary axial sectional view of the projectile illustrating the base-mounted fuze assembly having the power supply of the present invention.

Referring to FIGS. 1-3, the fuze assembly 32 is packaged as a module within the base 38 of the projectile 24. The fuze assembly 32 includes a cup 44 housing a central electric detonator 46 aligned with an initiator tube 48 which extends forward of the cup 44 and into the high explosive in the body assembly 36. An arming delay mechanism 50 is disposed between and separates the detonator 46 and initiator tube 48 for providing static detonator safety until arming is initiated. An electronic module 52, containing a detonator control and initiating circuit and an impact sensor, is provided in the volume of the cup 44 around and to the rear of the detonator 46.

Figure 4:
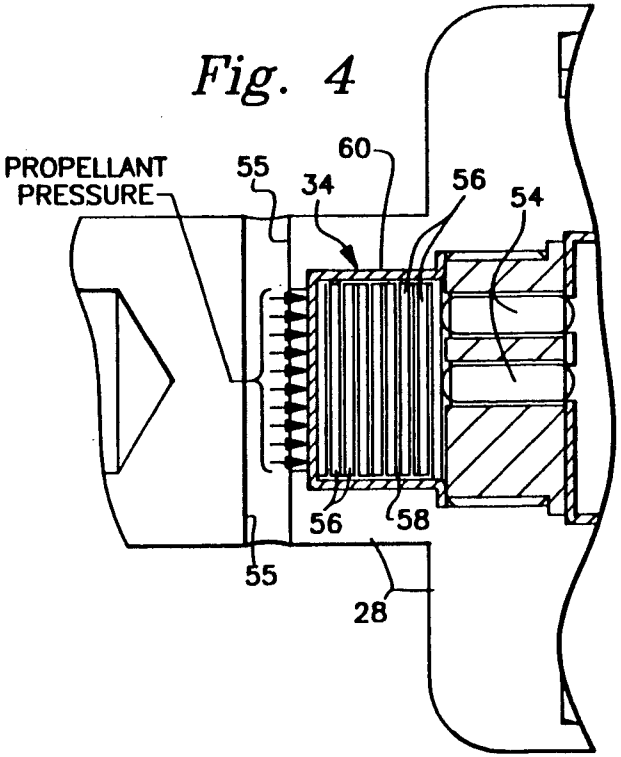
FIG. 4 is an enlarged view of the power supply of the base-mounted fuze assembly shown in FIG. 3.

Referring to FIGS. 2-4, the fuze assembly 32 also includes an electrical feed-through plug 54 which is located aft of the cup 44 and forward of the piezoelectric power supply 34 of the present invention. The plug 54 and power supply 34 are located at the location of mating of the forward end of the piston 28 and the base 38 of the projectile 24. The electrical feed-through plug 54 has glass-to-metal seals providing electrical connection between the power supply 34 and the electronic module 52.

More particularly, the piezoelectric power supply 34 is initiated or activated by high gas pressure generated by burning of the propellant charge 20 which launches the projectile 24. Thus, the piezoelectric power supply 34 of the present invention utilizes the surplus available high energy from the propellant gas pressure which is used primarily for accelerating the projectile 24 in the gun barrel. The piezoelectric material of the power supply 34 converts the energy from gas pressure to electricity. Radial passages 55 are defined in the piston 28 leading inwardly from the case chamber 18 containing the propellant charge 20 to the rear side of the power supply 34. The propellant gas pressure is communicated through these passages 55 to the power supply 34.

Figure 5:
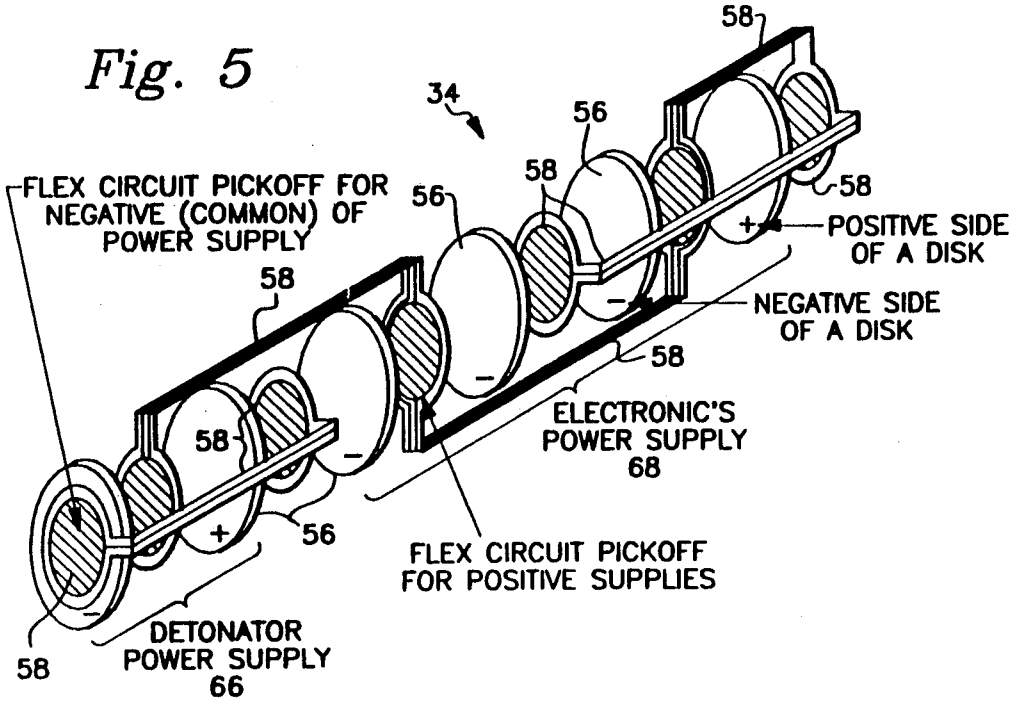
FIG. 5 is an expanded perspective schematic representation of the power supply of FIG. 4.
Figure 6:
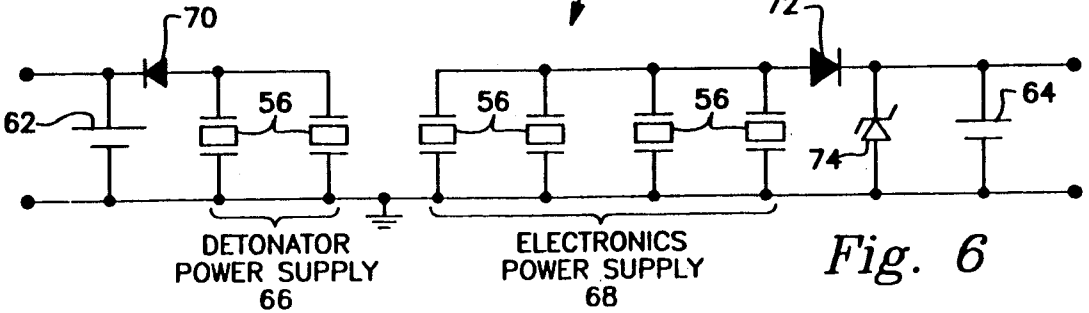
FIG. 6 is a schematic representation of the power supply of FIG. 5.

Referring to FIGS. 5 and 6, in its basic components, the piezoelectric power supply 34 includes a plurality of piezoelectric transducer elements 56 and a plurality of conductor elements 58. Preferably, the piezoelectric elements 56 are in the form of piezoelectric ceramic discs disposed in a stacked array and having opposite positive and negative faces, as identified by "+" and "−" signs in FIG. 5. Also, the conductor elements 58 ar preferably flexible circuits in the form of conductive paths formed on one surface of lengths of a flexible plastic sheet material, such as Kaptan. Portions of the flexible circuits 58 are interposed between the piezoelectric ceramic discs 56 and interconnect the corresponding positive and negative faces thereof so as to conduct electrical current and provide positive and negative pickoffs or terminals. Further, as explained below, the use of piezoelectric discs 56 in a stacked array together with the flexible circuits 58 makes it possible to partition the voltage outputs to perform different electrical functions at different voltage levels.

The power supply 34 also includes an enclosure 60 in the form of a hollow can in which is disposed the array of piezoelectric discs 56 and the flexible circuits 58. The enclosure 60 is connected to the electrical feed-through plug 54 which provides electrical connection of the flexible circuits with electrical capacitors 62, 64 in the circuits of the electronic module 52. The can 60 is deformable upon receipt of a predetermined pressure impulse, such as the propellant gas pressure via the radial passages 55. Deformation of the enclosure 60 transmits pressure to the piezoelectric ceramic elements 56 which, in turn, generate an electrical current which is collected at the storage capacitors 62, 64.

Additionally, the flexible circuits 58 are arranged with the piezoelectric discs 56 so as to divide the piezoelectric discs 56, for example, into two groups defining separate power supply portions 66, 68 for providing electrical power to different electrical functions. The one power supply portion 66 is connected via he electrical feed-through plug 54 to the one storage capacitor 62 in the circuit of the module 52 for firing the detonator 46. The other power supply portion 68 is connected via the electrical feed-through plug 54 to the other storage capacitor 64 in the circuit of the module 52 providing the electronics or controlling the timing of the detonation as well as other functions. Blocking diodes 70, 72 are connected to the respective power supply portions 66, 68 to prevent discharge of the capacitors 62, 64 in the reverse direction. Also, an overvoltage protection diode 74 is provided in the power supply portion 68 to protect the electronics.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A piezoelectric power supply for a fuze assembly, comprising:

(a) a stacked array of piezoelectric elements having opposite positive and negative faces;

(b) a hollow enclosure for holding said stacked array of piezoelectric elements and being deformable upon receipt of a predetermined pressure impulse for transmitting the pressure impulse to said elements;

(c) at least one capacitor capable of storing an electrical charge; and (d) a plurality of electrical conductor elements providing positive and negative output terminals, said capacitor being connected across said output terminals, said electrical conductor elements being composed of flexible circuits defined by lengths of flexible sheet material and conductive paths formed on one surface of said lengths of flexible sheet material, portions of said flexible circuits being interposed between said piezoelectric elements and interconnecting said corresponding positive and negative faces thereof so as to conduct electrical current to said positive and negative output terminals thereof and supply electrical charge to said capacitor upon deformation of said enclosure and piezoelectric elements by the pressure impulse.

2. The power supply of claim 1 wherein said piezoelectric elements are piezoelectric ceramic discs.

3. The power supply of claim 1 wherein said conductor elements are arranged with said piezoelectric elements so as to divide said piezoelectric elements in a plurality of groups defining separate power supply portions for providing electrical power to different electrical functions.

4. In a fuze assembly including a piezoelectric power supply and means for storing an electrical charge to power detonation of an explosive, said piezoelectric power supply comprising:

(a) a stacked array of piezoelectric elements having opposite positive and negative faces;

(b) a hollow enclosure for holding said stacked array of piezoelectric elements and being deformable upon receipt of a predetermined pressure impulse for transmitting the pressure impulse to said elements; and (c) a plurality of electrical conductor elements composed of flexible circuits defined by lengths of flexible sheet material and conductive paths formed on one surface of said lengths of flexible sheet material, portions of said flexible circuits being interposed between said piezoelectric elements and interconnecting said corresponding positive and negative faces thereof so as to conduct electrical current and provide positive and negative terminals connected to said electrical charge storing means for supplying electrical charge thereto upon deformation of said enclosure and piezoelectric elements by the pressure impulse.

5. The power supply of claim 4 wherein said piezoelectric elements are piezoelectric ceramic discs.

6. The power supply of claim 4 wherein said conductor elements are arranged with said piezoelectric elements so as to divide said piezoelectric elements in first and second groups defining separate power supply portions for providing electrical power to different electrical functions.

7. The power supply of claim 4 further comprising an electrical feed-through element disposed between and electrically connecting said positive and negative terminals to said electrical charge storing means.

8. In a fuze assembly including a piezoelectric power supply and first and second electrical capacitors for storing electrical charge to provide electrical power to different electrical functions, said piezoelectric power supply comprising:

(a) a stacked array of piezoelectric elements having opposite positive and negative faces;

(b) a hollow enclosure for holding said stacked array of piezoelectric elements and being deformable upon receipt of a predetermined pressure impulse for transmitting the pressure impulse to said elements; and (c) a plurality of electrical conductor elements interposed between said piezoelectric elements and interconnecting said corresponding positive and negative faces thereof so as to conduct electrical current and divide said piezoelectric elements in first and second groups defining separate power supply portions providing positive and negative terminals connected to said first and second capacitors for supplying electrical charge to said different electrical functions upon deformation of said enclosure and piezoelectric elements by the pressure impulse.

9. The power supply of claim 8 wherein said piezoelectric elements are piezoelectric ceramic discs.

10. The power supply of claim 8 wherein said conductor elements are flexible circuits.

11. The power supply of claim 8 further comprising a electrical feed-through element disposed between and electrically connecting said first and second power supply portions to said first and second capacitors.

12. The power supply of claim 11 further comprising first and second blocking diodes interposed between said respective first and second power supply portions and said corresponding first and second storage capacitors.

13. A piezoelectric power supply for a fuze assembly, comprising:

(a) a stacked array of piezoelectric elements having opposite positive and negative faces;

(b) a hollow enclosure for holding said stacked array of piezoelectric elements and being deformable upon receipt of a predetermined pressure impulse for transmitting the pressure impulse to said elements; and (c) a plurality of electrical conductor elements composed of flexible circuits defined by lengths of flexible sheet material and conductive paths formed on one surface of said lengths of flexible sheet material, portions of said flexible circuits being interposed between said piezoelectric elements and interconnecting said corresponding positive and negative faces thereof so as to conduct electrical current upon deformation of said enclosure and piezoelectric elements by the pressure impulse;

(d) said conductor elements also being arranged with said piezoelectric elements so as to divide said piezoelectric elements into first and second groups defining separate power supply portions and to provide first and second sets of positive and negative output terminals for supplying separate electrical charges to said first and second sets of output terminals.

* * * * *